US011517801B2

(12) United States Patent
Plizga

(10) Patent No.: US 11,517,801 B2
(45) Date of Patent: Dec. 6, 2022

(54) HOCKEY STICK BLADE COVER

(71) Applicant: Craig J Plizga, Glenwood Springs, CO (US)

(72) Inventor: Craig J Plizga, Glenwood Springs, CO (US)

( * ) Notice: Subject to any disclaimer, the term of this patent is extended or adjusted under 35 U.S.C. 154(b) by 0 days.

(21) Appl. No.: 16/895,512

(22) Filed: Jun. 8, 2020

(65) Prior Publication Data

US 2020/0384325 A1 Dec. 10, 2020

Related U.S. Application Data

(60) Provisional application No. 62/857,894, filed on Jun. 6, 2019.

(51) Int. Cl.
*A63B 60/62* (2015.01)
*A63B 59/70* (2015.01)
*A63B 102/24* (2015.01)

(52) U.S. Cl.
CPC ..... *A63B 60/62* (2015.10); *A63B 59/70* (2015.10); *A63B 2102/24* (2015.10); *A63B 2209/00* (2013.01)

(58) Field of Classification Search
CPC ..... A63B 59/14; A63B 59/00; A63B 69/36; A63B 69/38
See application file for complete search history.

(56) References Cited

U.S. PATENT DOCUMENTS 2,608,409 A * 8/1952 Pinkerton ..... A63B 69/3638 473/437
3,834,697 A * 9/1974 McNamara, Jr. .. A63B 69/0026 482/109
5,127,649 A * 7/1992 Carbonero ..... A63B 59/70 473/563
5,520,386 A * 5/1996 Sasko ..... A63B 69/3638 473/437
5,836,841 A * 11/1998 Fell ..... A63B 59/70 473/563
2004/0097306 A1* 5/2004 Dehen ..... E01H 1/12 473/563
2014/0144562 A1* 5/2014 Hillard ..... A45C 1/10 150/143

* cited by examiner

*Primary Examiner* — Eugene L Kim
*Assistant Examiner* — Christopher Glenn
(74) *Attorney, Agent, or Firm* — Leyendecker & Lemire

(57) ABSTRACT

A cover for a blade of a hockey stick are described wherein the cover includes a substantially flat bottom surface that is designed to lay flat against the surface of ice. The cover is designed and configured to be used to on the ice by a new or novice skater who holds the shaft of the hockey stick while skating and uses the stick and cover combination as a balancing aid.

6 Claims, 16 Drawing Sheets

HOCKEY STICK BLADE COVER

BACKGROUND

Learning to skate can be difficult let alone learning how to skate properly with good form. Unfortunately, about the only skating aids allowed or available for use on a rink during a public skate are skating trainers, devices shaped like support walkers. While these devices can help support a novice skater and reduce the risk of him/her falling down, they are not particularly fun to use and very good at helping the skater learn to skate properly. Essentially, they put a user in an upright stance with his/her legs straight directly underneath his/her torso; whereas in contrast, proper skating techniques requires a skater's knees to be bent and to take strides.

DETAILED DESCRIPTION

Figure 1:
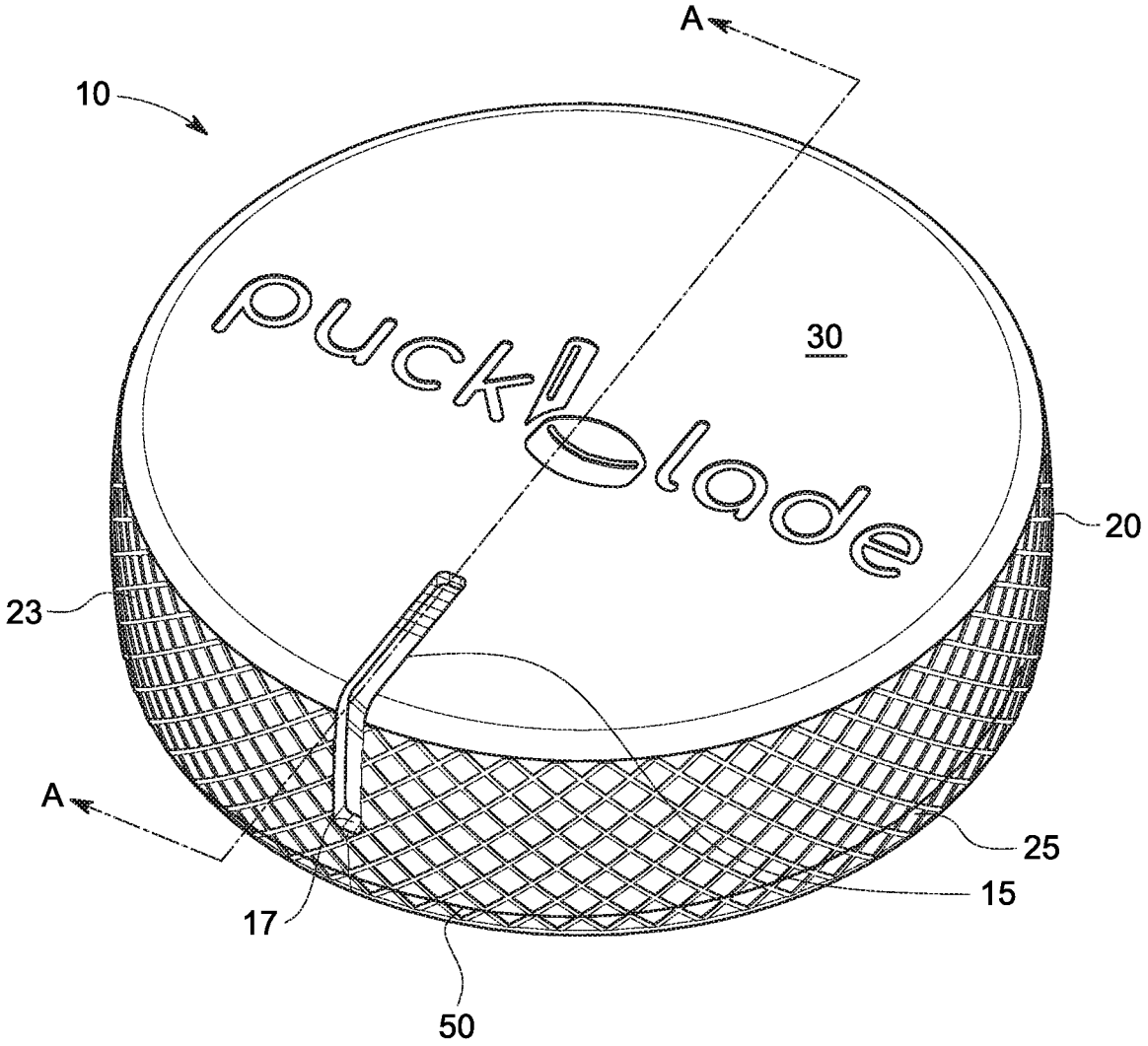
FIG. 1 is a perspective top view of the blade cover according to one embodiment of the present invention.
Figure 2:
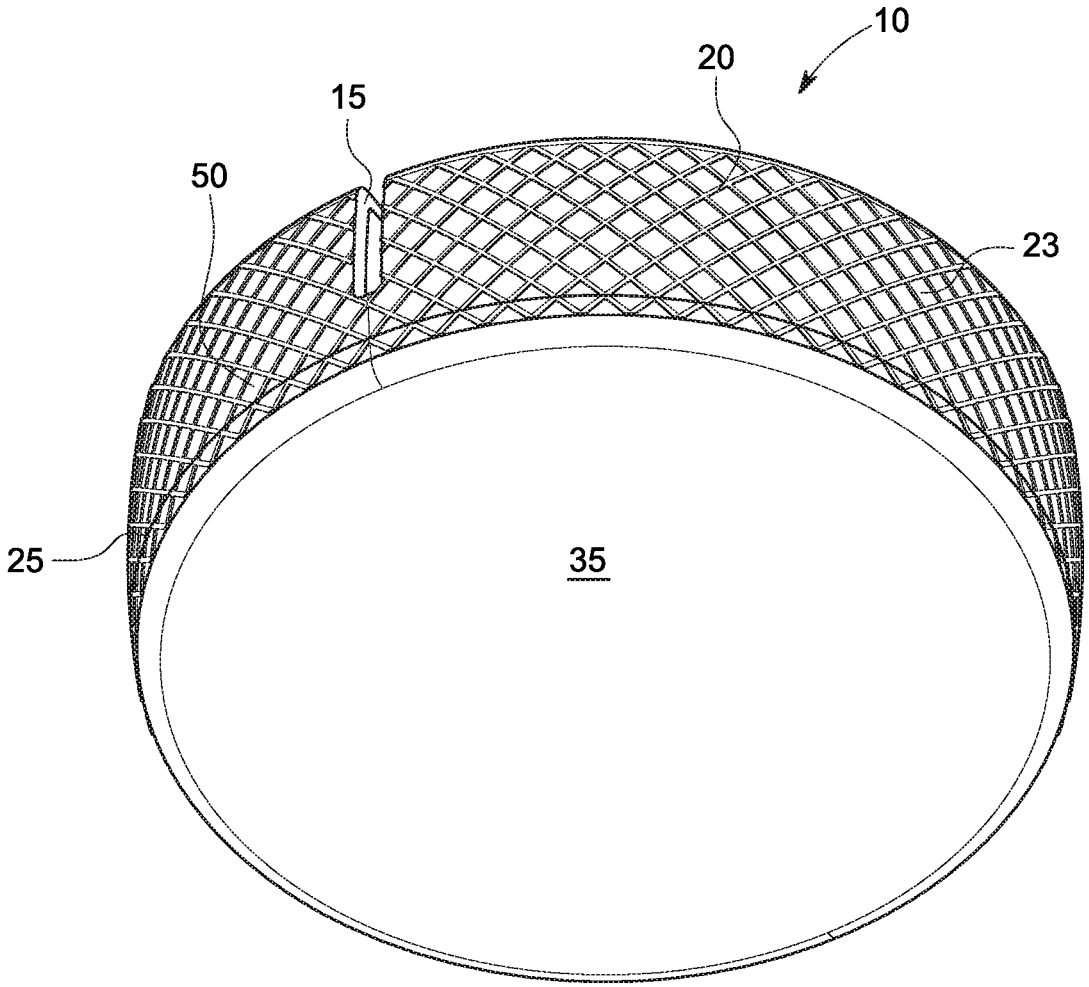
FIG. 2 is a perspective bottom view of the blade cover according to the embodiment of the present invention.

Hockey players routinely and instinctively use their sticks as skate-aids. Hockey Sticks permits them to both skate freely and they provide a bit of support when needed. In this regard hockey sticks are akin to canes. In contrast, prior art skate aids are akin to walkers: it is there to be used only when the skater loses or begins to lose his/her balance. The amount of support offered by a hockey stick is relatively small but a small amount of potential extra support can often make the difference between falling and remaining upright.

Embodiments of the present invention comprise a disk-shaped cover for a blade of a hockey stick wherein the cover is relatively weighty and includes a substantially flat bottom surface that is designed to lay flat against the surface of ice. The cover is designed to be used in concert with a hockey stick as an enhanced balancing aid over a hockey stick by itself to be used by a new or novice skater. It further helps teach the novice skater how to hold a hockey stick while skating.

Embodiments of the cover, some of which can be shaped like and resemble an oversized hockey puck, are typically made of a semi-hard to hard elastomeric material, such as polyurethane or a synthetic rubber. In the illustrated embodiment the cover is injection molded as two pieces that are bonded together. Opposing ridges, nubbins and/or constraining walls are provided on the downwardly and upwardly facing interior surfaces to help frictionally hold and secure the blade of the hockey stick therein.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

As used herein, the term "nubbin" refers to a discreet protrusion that extends from an associated surface. Nubbins are typically cylindrical and relatively squat in height but as used herein the general cross sectional shape of a nubbin can vary and include, but is not limited to, circular, ovular, rectangular, and triangular. While the nubbins depicted in the figures are relatively squat in height, it is appreciated they can be longer in variations. As used herein unless otherwise specified the term "nubbin" is synonymous with the term "post", A "squat nubbin" is a nubbin where in the height of the nubbin compared to its diameter or width is no greater than 1.5 times, and more preferably about 1.0 times.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

Embodiments of a Hockey Stick Blade Cover

FIGS. 1-9 illustrate embodiments of a hockey stick cover 10 according to the present invention. Essentially, the cover comprises a disk having an annular vertical side 23 spanning between a bottom perimeter of a bottom side 35 and a top perimeter of a top side 30 to define a hollow interior 27. At least the bottom surface of the bottom side being substantially flat. The overall height of the cover is typically about three inches, although the height is dictated by the height of the blade 105 of a hockey stick 100 it is configured to be received in the hollow interior. The thicknesses of the various sides can vary depending on several factors including the material from which the cover is made, the desired weight of the cover, and the cost and amount of material used to produce the cover. In at least one variation, the side walls are about 0.19" thick.

A slot 15 is provided extending vertically upwardly along a portion of the vertical side 23 beginning at a bottom end (or slot lip 17) located a predetermined distance above the bottom side 35 depending on the size of a hockey stick blade to be received therein, and extending radially inwardly along the top side 30 to a slot inside end for a predetermined length (typically about three inches). The slot is typically about 0.3" wide to accommodate the blade 105 of a hockey stick 100, although this can vary depending on the width of the blade intended to be received in the cover.

The cover 10 can be made of any suitable material and by any suitable manufacturing process; however, the illustrated embodiment comprises two separate pieces 20&25 that are subsequently joined, such as by adhesive bonding to create a one piece cover. The top piece of the illustrated embodiment includes the top side 30 and a substantially all of the annular side 23. The bottom piece primarily comprises the bottom side 35. Typically, both the top piece 20 and bottom piece 25 are molded, such as injection molded, from a semi-hard to hard elastomeric material; an adhesive is typically applied to a groove or lip formed in one or both the bottom and top pieces; and the top piece is placed on to the bottom piece securing them together at a seam 50 once the adhesive has cured. In one variation the elastomeric material has a Shore A hardness of about 80, although materials that are either softer or harder than 80 can also be utilized.

As best shown in FIGS. 3-6 the interior 27 of the cover 10 is substantially hollow. FIGS. 4A,B&C show three variations of the interior surface of the top side 30. FIGS. 5A,B&C show two variations of the interior surface of the bottom side 35. As is evident in each of the figures, the interior surfaces are substantially flat except for either downwardly or upwardly extending protrusions 40,45,55, 60,75&80. These protrusions are integrally molded into the cover and, as such, comprise the same resilient material as the remainder of the cover. They act to help hold the blade of a hockey stick therein as shown in FIGS. 6A,B&C and described below.

Figure 4A:
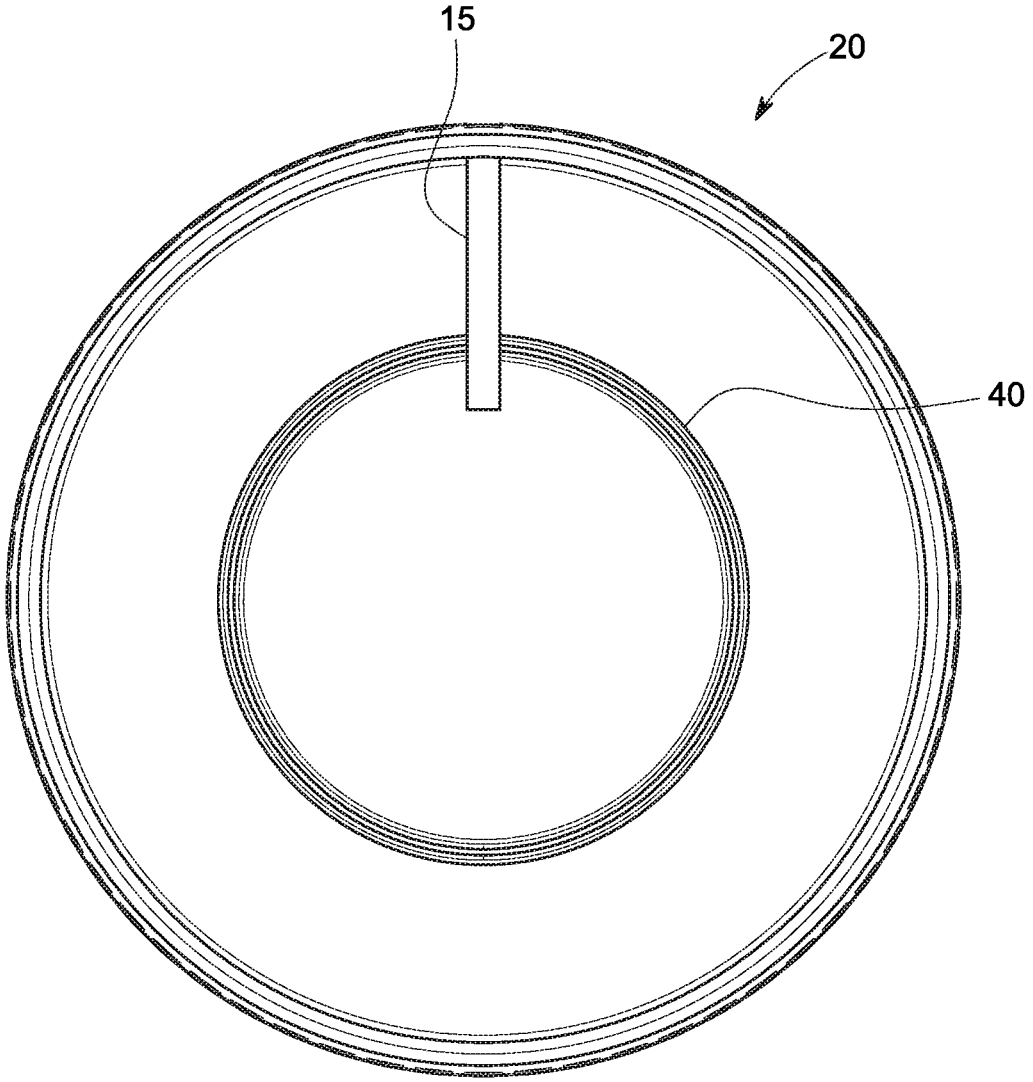
FIG. 4*a,b*&c are upwardly looking views of the bottoms of three embodiments of the top piece of the blade cover.
Figure 4B:
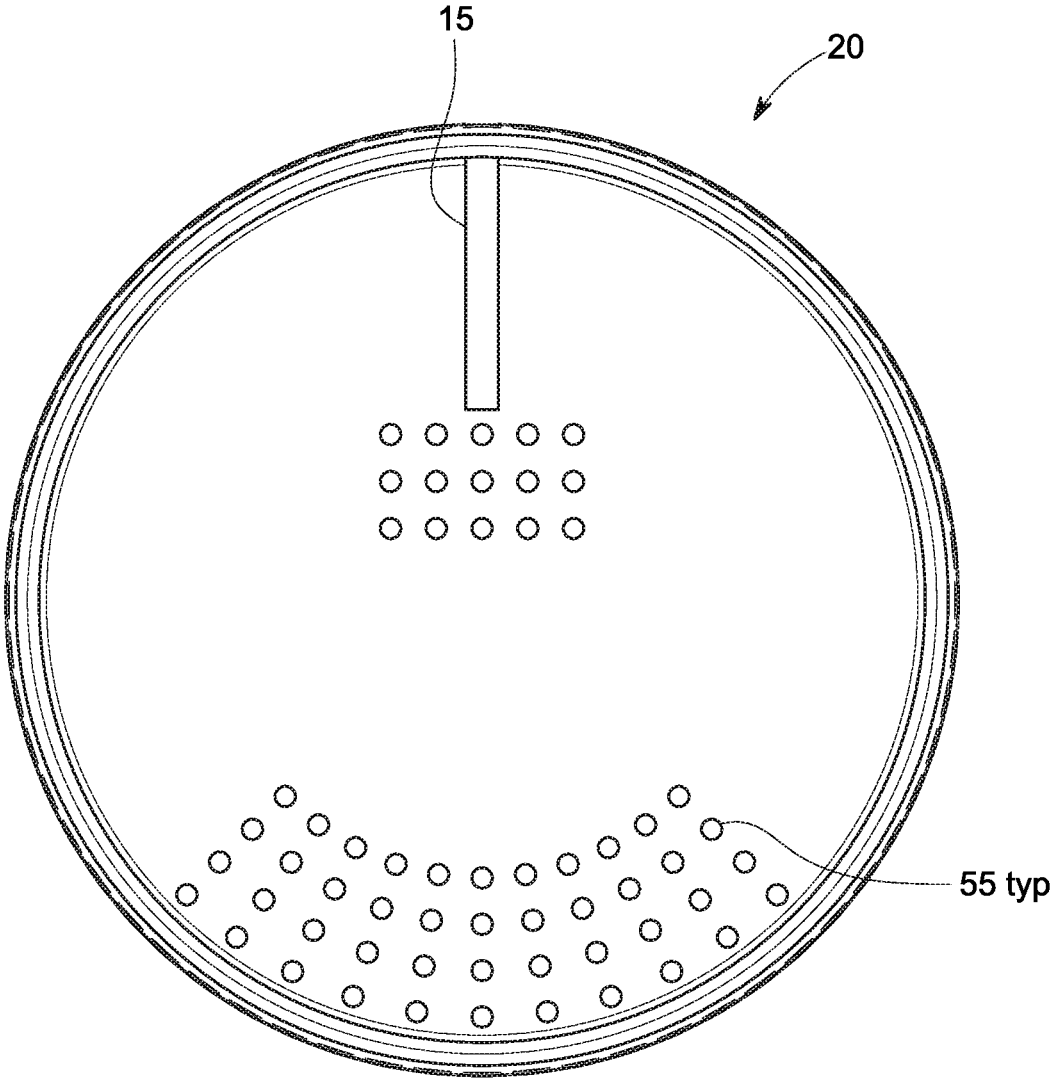
Figure 5A:
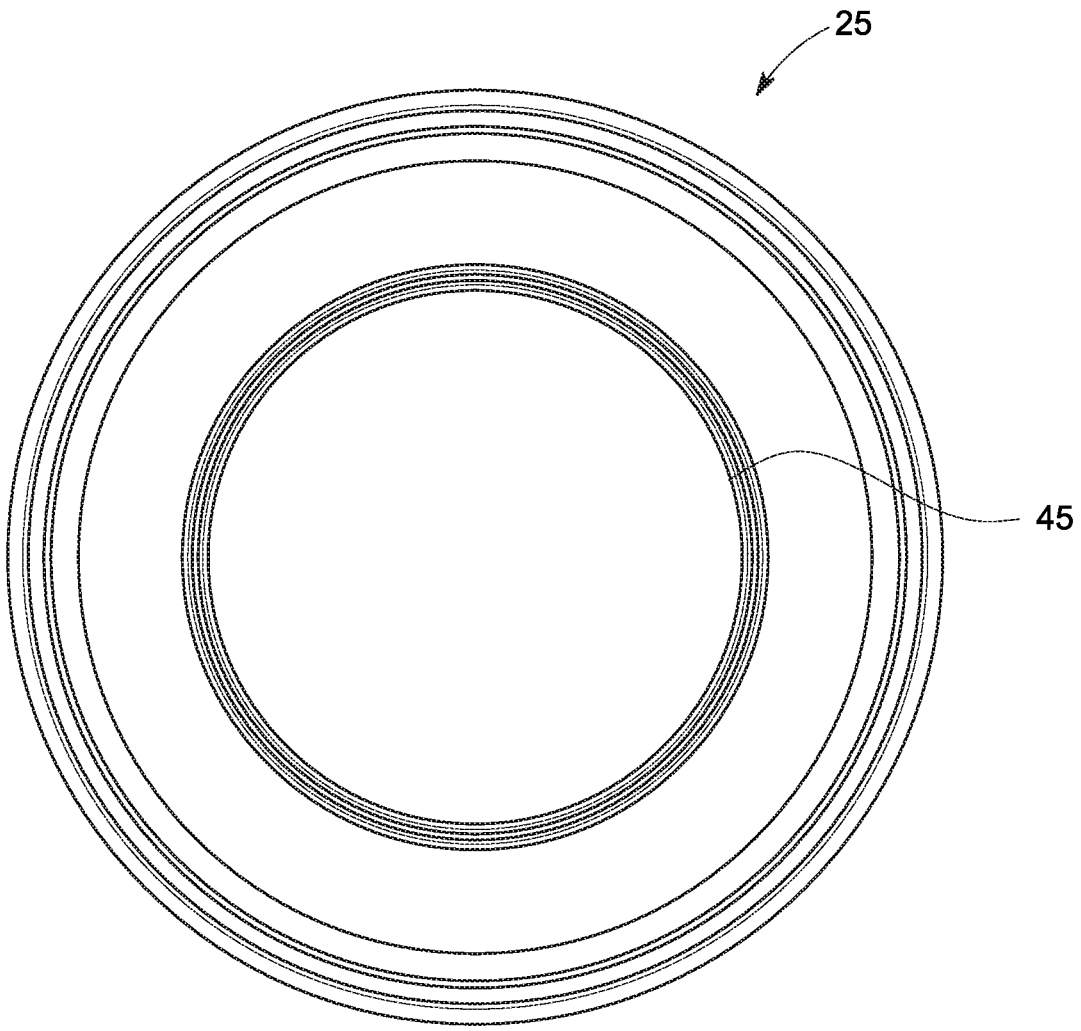
FIGS. 5*a,b*&c downwardly looking views of the tops of three embodiments of the bottom piece of the blade cover.
Figure 5B:
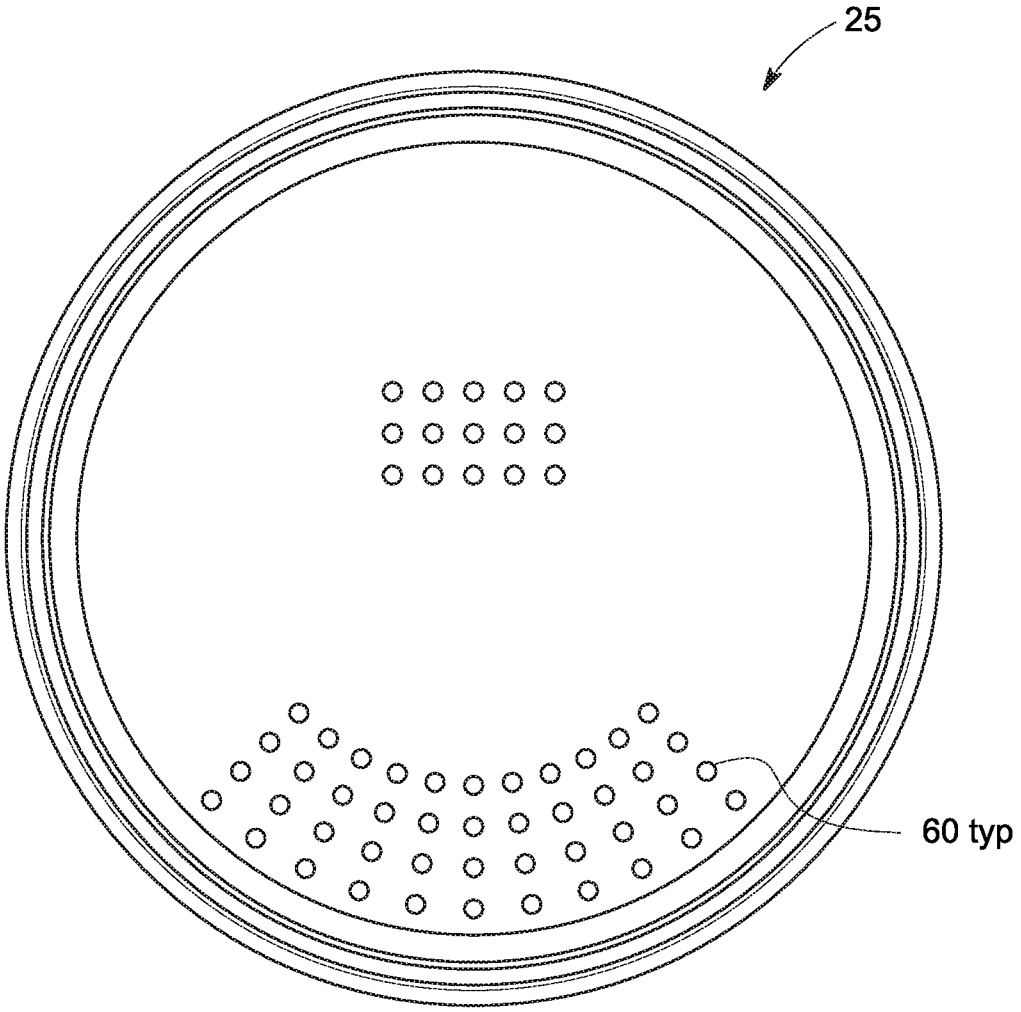
Figure 5C:
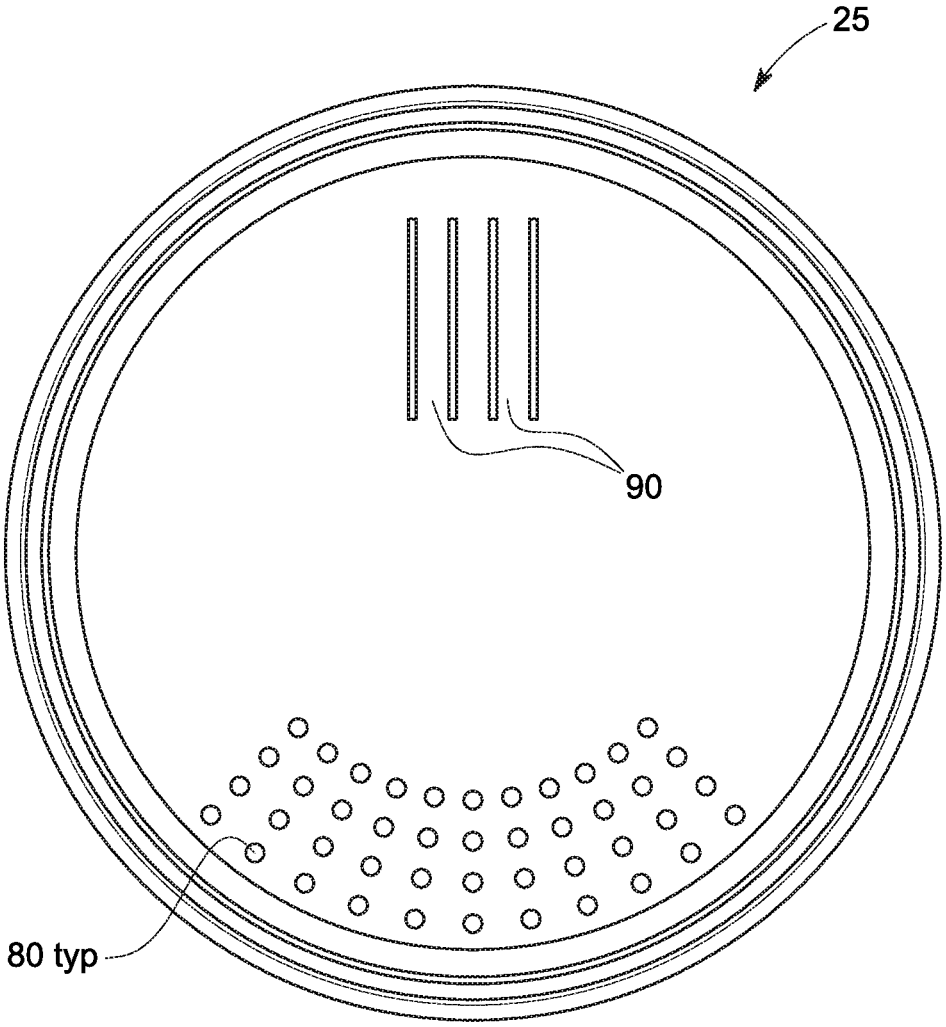

In the cover variations shown in FIGS. 4A&5A the protrusions comprise downwardly-extending and upwardly extending annular ridges 40&45 that are spaced from and centered about the center point of the top and bottom side interior surfaces respectively. The ridges are generally triangular in cross section and extend about 0.25" from the associated surface in one variation.

In FIGS. 4A&5A the protrusions comprise downwardly-extending and upwardly extending nubbins 55&60 arranged in several arrays. A first upper array is adjacent to and located radially inward of the inner end of the slot 15 on the interior surface of the top side. The first lower array is located directly below the first upper array on the interior surface of the bottom side. An arcuately-configured second upper array is spaced from the first upper array on an opposite side of the center point of the interior surface generally adjacent to the top perimeter. An arcuately-configured second lower array is typically located directly below the second upper array. In one variation the nubbins are about 0.13" in diameter and about 0.25" tall although the dimensions can vary significantly in other variations.

Figure 3A:
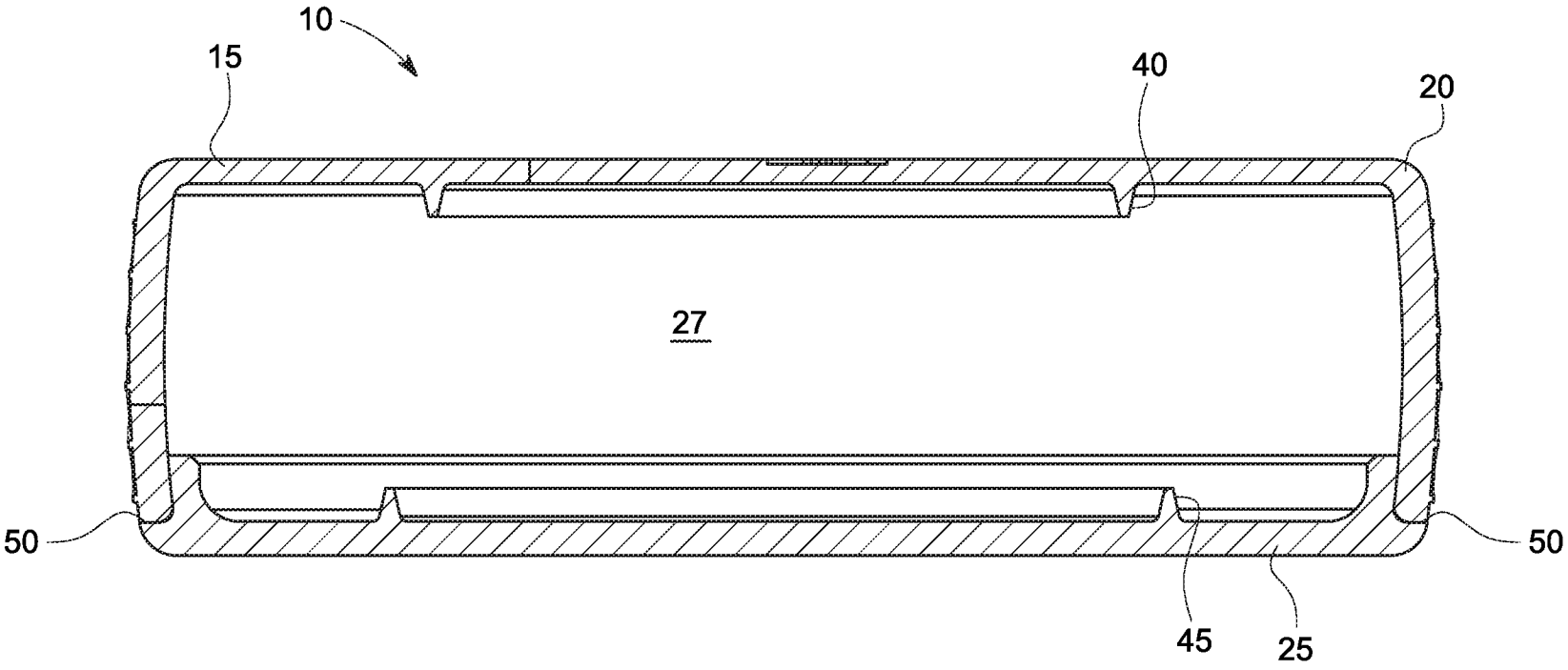
FIG. 3*a*&*b* are cross section side views of the blade cover taken along line A-A of FIG. 1 according to two embodiments of the present invention.
Figure 3B:
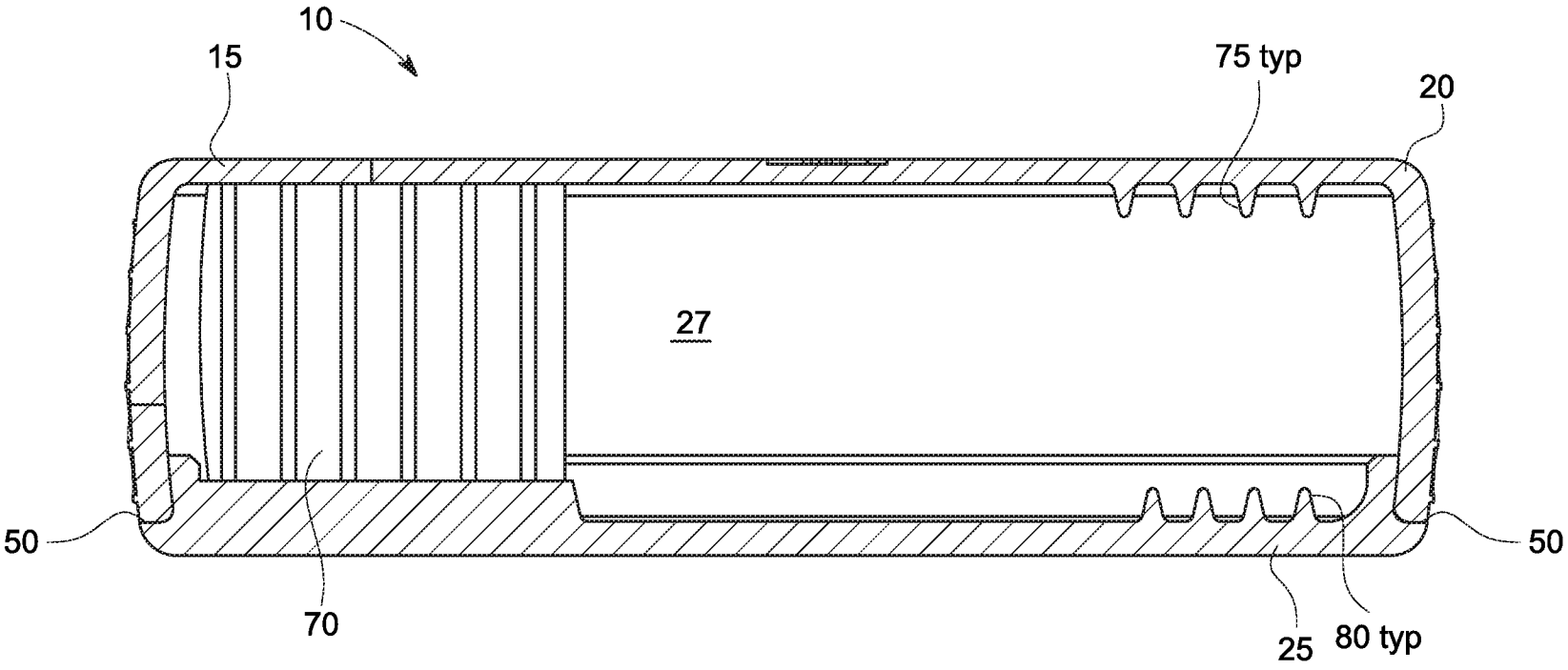
Figure 8:
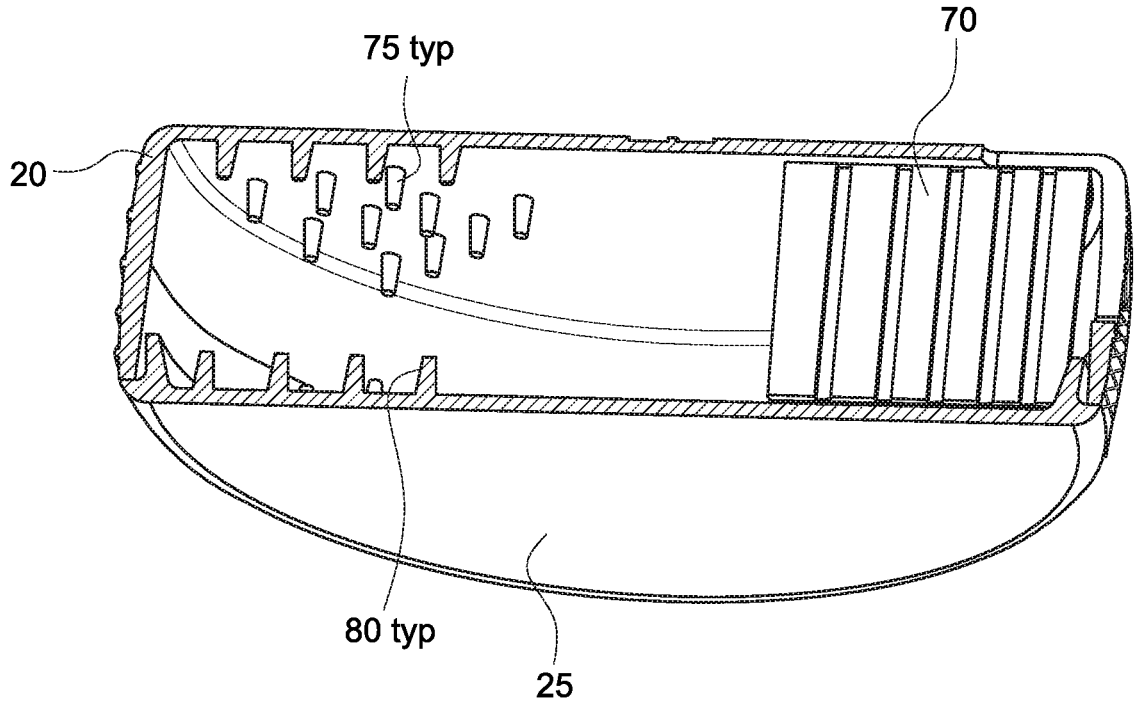
FIG. 8 is a perspective cross sectional view of an embodiment of the present invention.
Figure 9:
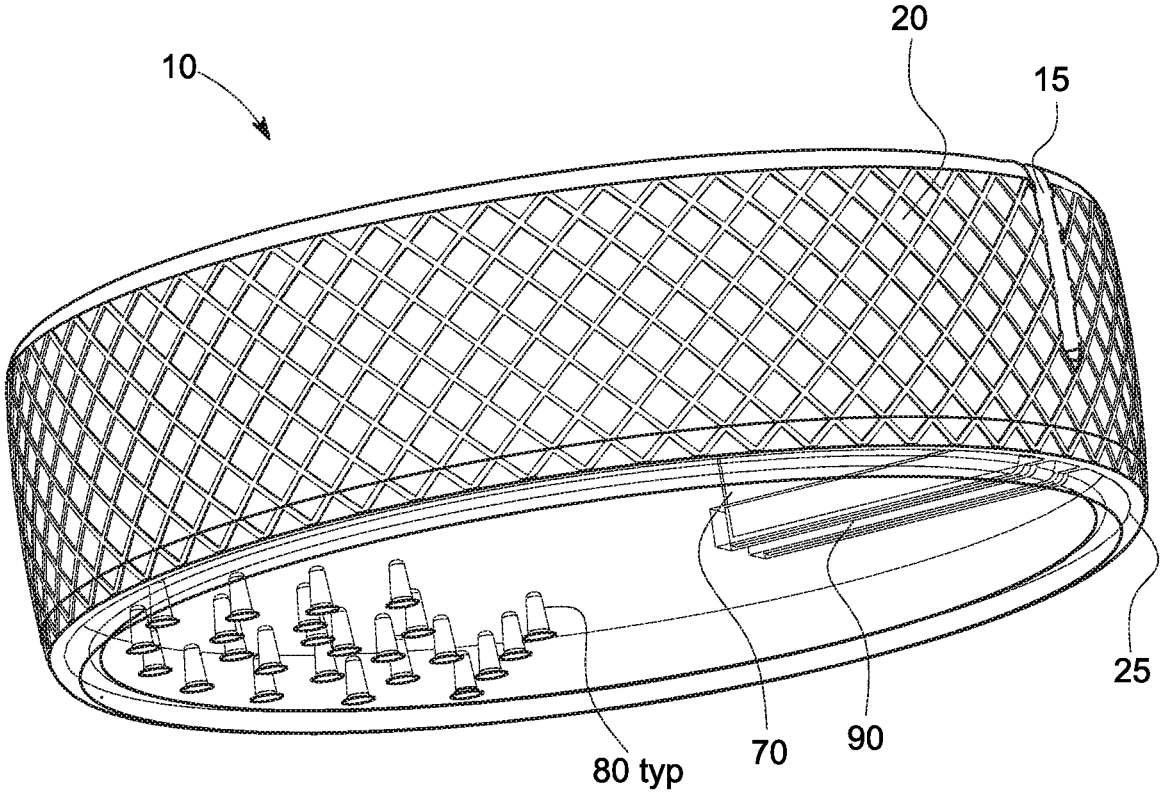
FIG. 9 is a perspective bottom side view of the same embodiment but wherein the bottom is shown as translucent to reveal the internal structure thereof.

In 4C&5C, the protrusions comprise a combination of left and right walls 70 that bound the slot 15, and upwardly and downwardly extending arrays of nubbins 75&80. This embodiment is also illustrated in FIG. 3B. The walls 70 are typically molded into the top side of the top piece and extend downwardly the entire distance height of the interior 27. The walls may be textured to help grip the sides of the hockey stick blade 105. As shown in FIGS. 3B&8, the wall surfaces comprise a series of parallel grooves. Further on the interior surface of the bottom pieces corresponding wall-receiving slits 90 are provided in which to receive the ends of the left and right walls when the top and bottom pieces are joined together with each slit being defined by a pair of parallel squat upwardly extending linear protrusions.

Figure 4C:
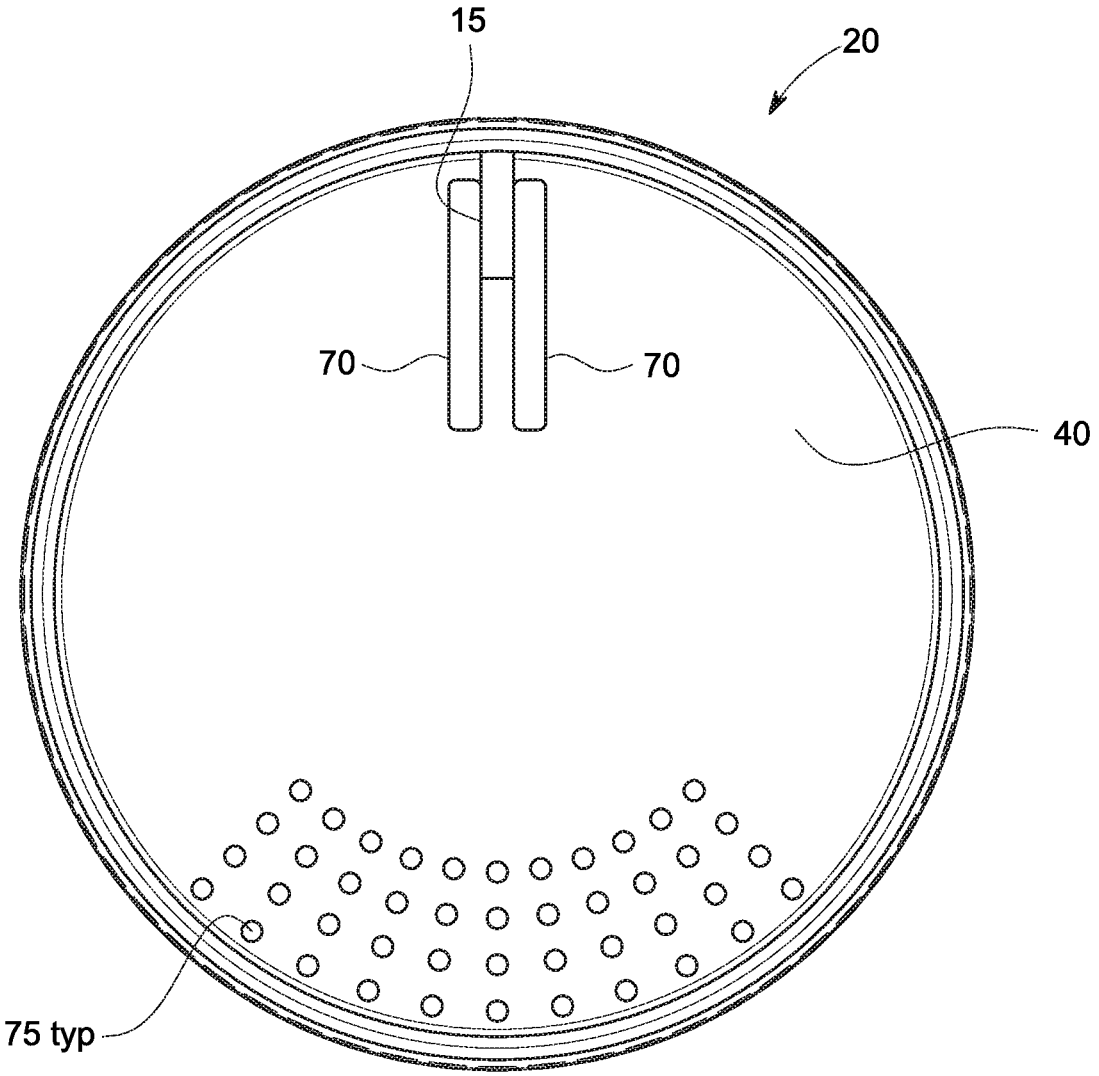

As also can be seen in FIGS. 4C&8, the length of the radially-extending portion of the slot 15 along the top side is shorter than on the other illustrated variations extending about 1.5 inches. As can be appreciated the length of the slot along the top side can vary in all of the variations such that the shorter length slot can be utilized in the other variations as well. The arrays of nubbins 75&80 in this variation are similar to the second upper and lower arrays described above relative to the embodiment of FIG. 4B in configuration and positioning.

Figure 6A:
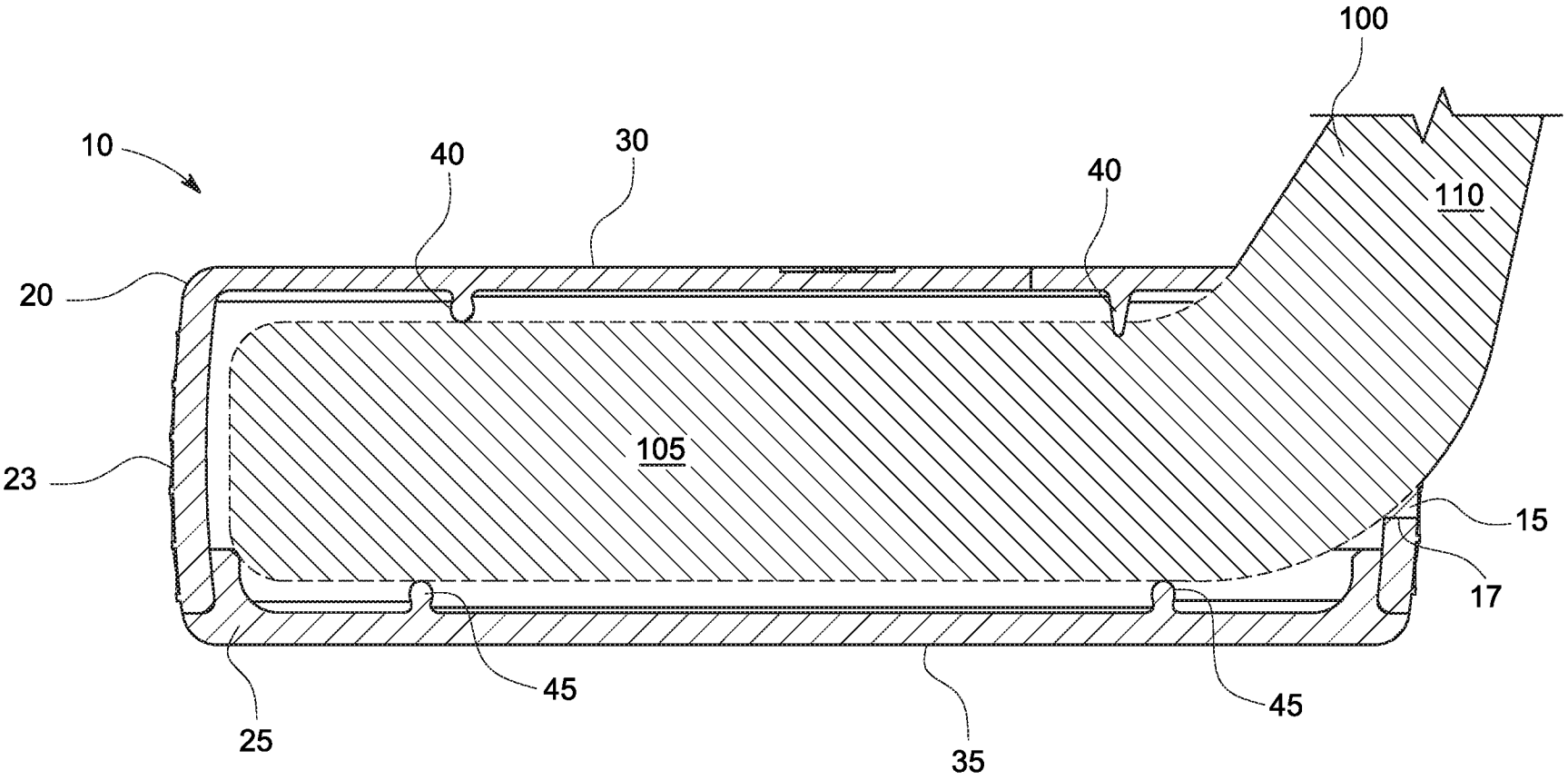
FIGS. 6*a,b*&c are cross sectional views of the cover with the blade of a hockey stick inserted therein according to three embodiments of the present invention.

FIGS. 6A&B&C and 7 illustrate the blade 105 of a hockey stick 100 substantially and removably received in the cover 10. When the blade is received in the cover and the cover's bottom side 35 is resting on a flat surface, such as that of an ice rink, the handle (or shaft) 110 of the hockey stick extends both upwardly and outwardly of the cover. The back edge of the blade intersects with and rests against the slot lip 17 of the slot 15 acting to hold the shaft in an upright manner. In use, a novice skater holds the handle with one or both hands while skating. In this manner, the cover and stick combination act to help stabilize the skater reducing his/her risk of falling while also promoting proper skating technique.

In some variations, the weight of the cover 10 may be sufficient so that stick 100 and cover combination remains upright and does not fall over when the handle 110 of the stick is released despite the fact that the handle may be angled outwardly of the cover as shown. As necessary, additional weight can be achieved by making one or more pieces thicker or adding one or more weights, typically made of steel or another heavy metal, that can be secured in the interior or even molded into the cover. In some variations, the cover weighs about two pounds and this has been found to be sufficient to hold a hockey stick upright; however, the actual weight required will depend on the diameter (or foot print) of the cover, the size and weight of the stick and the angle at which the handle projects outwardly from the cover.

Figure 6B:
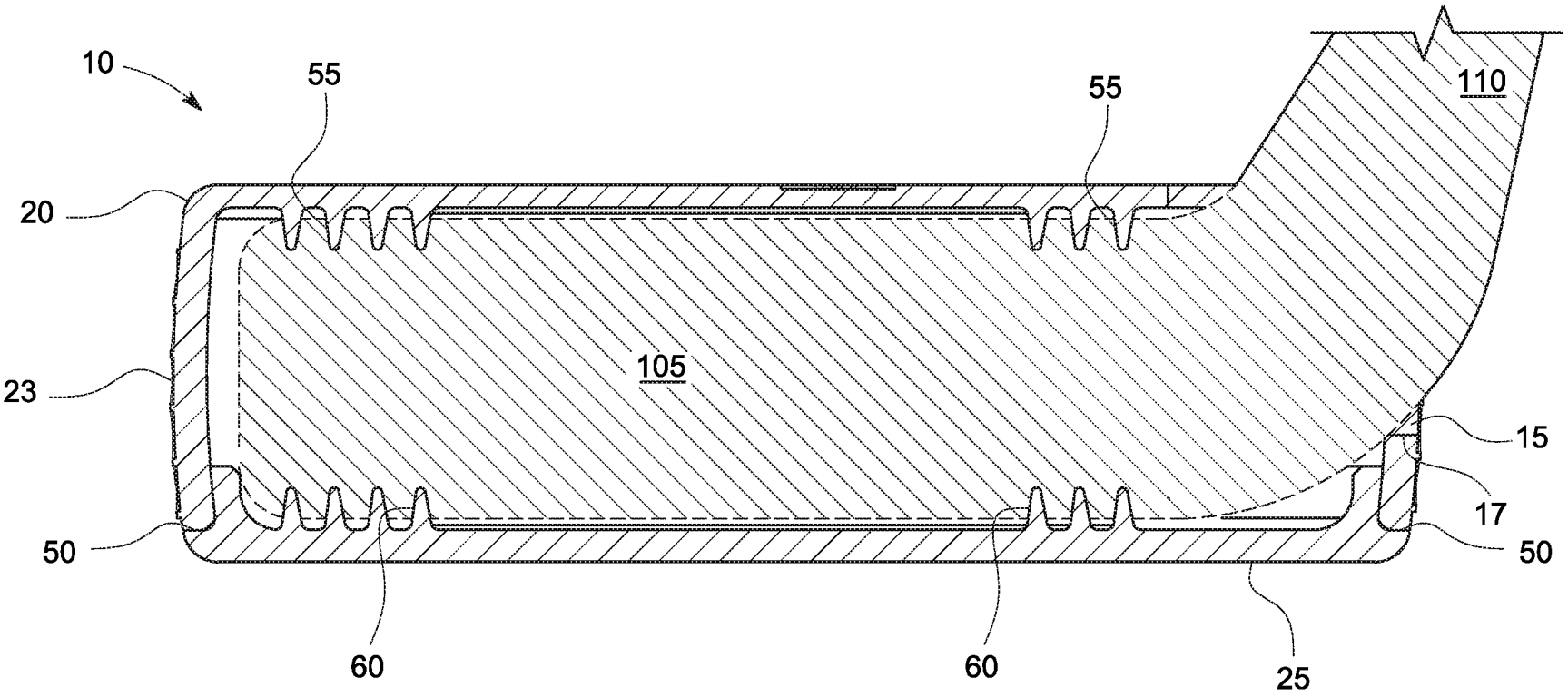
Figure 6C:
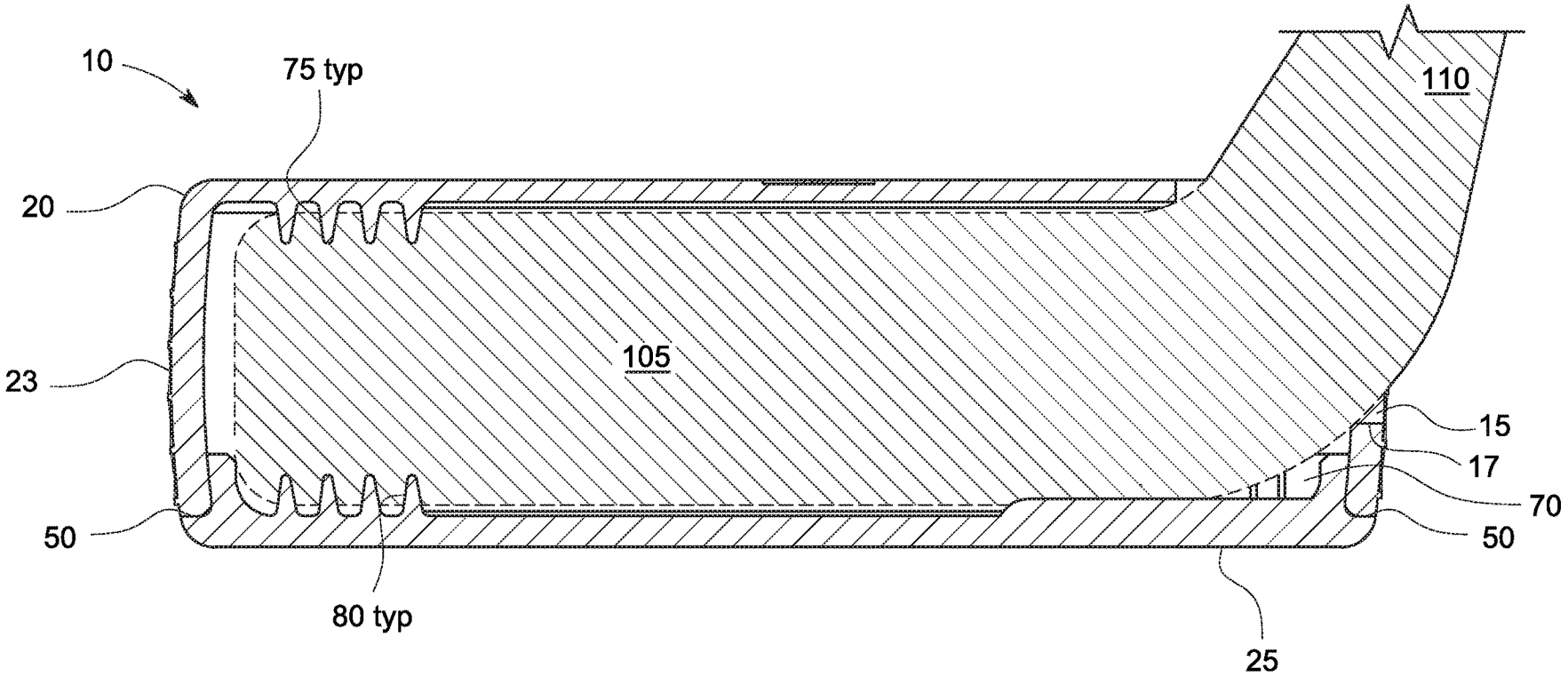
Figure 7:
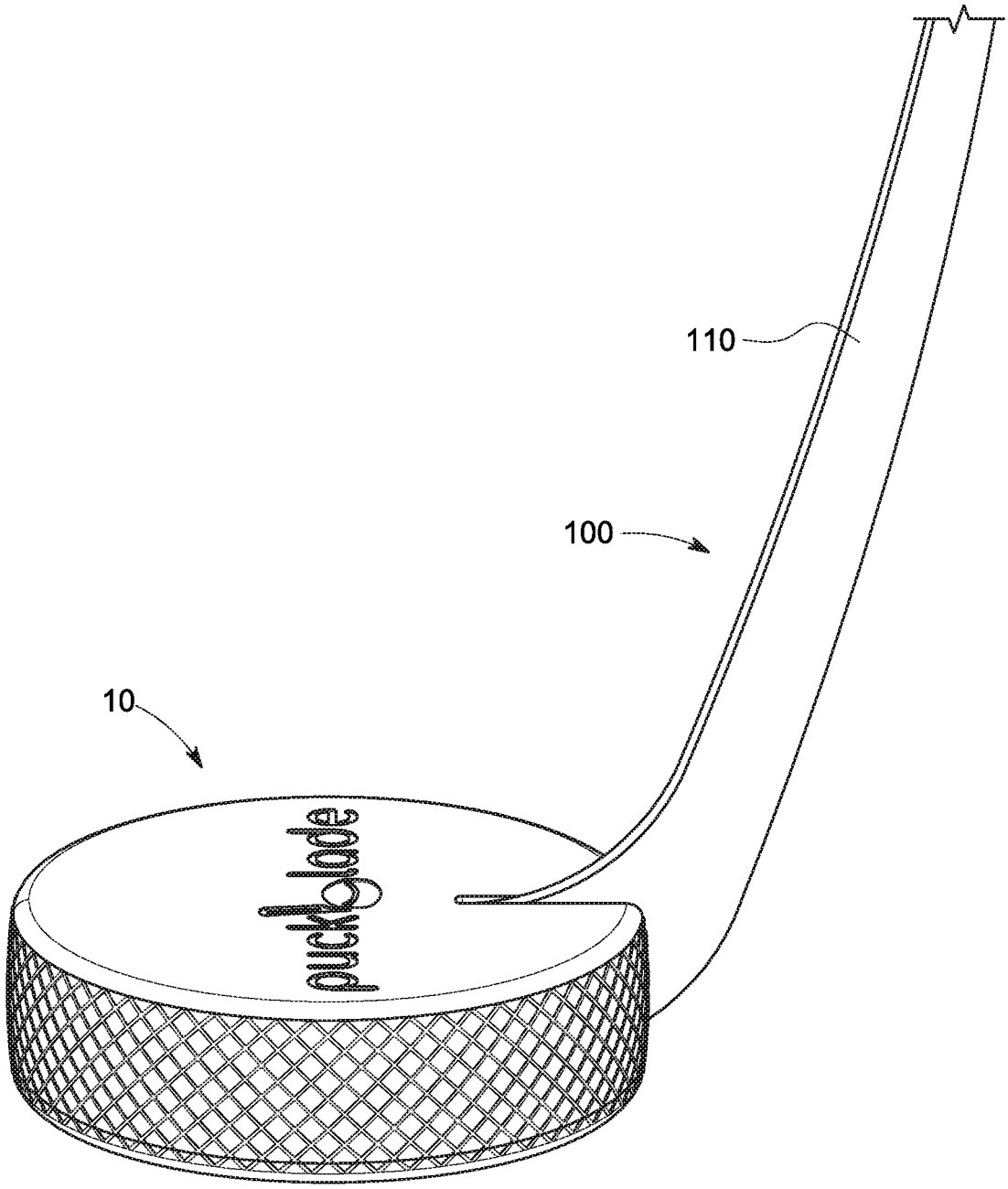
FIG. 7 is a perspective view of the cover with a hickey stick inserted therein according to an embodiment of the present invention.

FIGS. 6A&B&C are cross sectional views of the interior of the cover 10 but with the blade 105 of a hockey stick 100 securely received therein. As can be seen most of the blade is contained within the hollow interior 27 of the cover with the front edge touching or almost touching the interior surface of the vertical annular side 23. A small portion of the blade, essentially where it begins to taper, may extend outside of the slot. The edges of the blade at this location interface with the left and right edges of the slot 15 to help hold the blade and stick in place. With reference to FIG. 6A, the ridges 40 & 45 may flex and compress to frictionally engage the top and bottom edges of the blade to further secure it in place. Further, the portions of the top ridge 40 bounding the edges of the slot may extend downwardly past the top edge of the blade to help hold it in place. With reference to FIG. 6B, the top and bottom edges of the blade above and below the nubbin arrays settle between nubbins 55&60, which also act to effectively secure the blade in place. With reference to FIG. 6C, the blade is sandwiched between left and right walls 70 proximate the slot 15 and where the wall extends forwardly therefrom. Proximate the distal end of the blade, the top and bottom edges thereof are received in between the upper and lower arrays of nubbins 75&80.

To install a hockey stick 100 in the cover 10, the front of the blade 105 is pushed into the interior of the cover by way of the slot 15. Typically, the blade is initially angled downwardly and pivoted towards horizontal as it is advanced into the interior towards the side of the vertical sidewall opposing the slot opening. As the blade is passed through and across the opposing ridges 40&45, through the opposing arrays of nubbins 55&60, or between the walls 70, the force necessary to slide the blade fully into the interior may increase. The cover can be placed against a wall or even in the corner of a wall to brace it and hold it in place while the stick is pushed further into the cover.

In use, a skater places the bottom side 35 of the cover 10 against the surface of an ice rink while holding the handle 110 in at least one hand. The novice skater then skates around the rink. While not providing the level of support of a traditional skating trainer, the combination does provide for enhanced balance and for balance recovery should the skater begin to lose balance. Further, unlike the skating trainer, the stick and cover combination encourages a skater to assume a proper skating stance with his/her legs bent and leaning slightly forward. The trainer can also be used by more experienced skaters who want to get ice time in to hone or improve their skills but must do so on a public rink during a public skate where uncovered sticks may be prohibited.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, variations and other embodiments are contemplated wherein the general shape of the cover is other than a circular disk resembling a puck as the wants and needs of the users dictate. As one example the cover could be shaped like a piece of cheese to appeal to users associated with Wisconsin. Another version could resemble a sting ray as might be popular in ice rinks in Florida. Further, the patterns molded and imprinted into the sides and top of the cover can change limited only by the creativity of a designer of a particular cover.

I claim:

1. In combination a hockey stick having a shaft and a blade extending outwardly of a bottom of the shaft, and a skating balancing aid, the skating balancing aid comprising:

a circular disk having, (i) a circular bottom side with a substantially planar continuous bottom surface, (ii) a top side, (iii) an annular vertical side spanning between the top and bottom sides, and (iv) a slot with generally parallel spaced apart left and right edges extending into an interior of the disk with the slot being located at least partially on the annular vertical side starting at a lower slot lip, extending to and spanning an intersection of the annular vertical side and the top side, and extending along the top side generally radially to a slot inside end terminating before a center of the top side;

wherein the blade is securely received though the slot blade and substantially enclosed in the interior.

2. The combination of claim 1 wherein the top side has a substantially continuous planar top surface.

3. The combination of claim 1 wherein the skating balancing aid weighs about 2 pounds.

4. The combination of claim 1 wherein the skating balancing aid is comprised substantially of an elastomeric material.

5. The combination of claim 4 wherein the elastomeric material has a Shore A hardness of about 80.

6. The combination of claim 1, wherein when the bottom surface is placed on a substantially horizontal surface the combination is self supporting with the shaft of the hockey stick extending upwardly without external support.

* * * * *